US006553596B2

(12) United States Patent
Kim et al.

(10) Patent No.: US 6,553,596 B2
(45) Date of Patent: Apr. 29, 2003

(54) METHOD FOR CONTROLLING WASHING MACHINE ACCORDING TO ABSORPTION CHARACTERISTICS OF THE LAUNDRY

(75) Inventors: Hyung-Sook Kim, Seoul (KR); Jong-Hun Won, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 2 days.

(21) Appl. No.: 09/977,291

(22) Filed: Oct. 16, 2001

(65) Prior Publication Data

US 2003/0024056 A1 Feb. 6, 2003

(30) Foreign Application Priority Data

Jul. 31, 2001 (KR) ..... 01-46165

(51) Int. Cl.[7] ..... D06F 33/02
(52) U.S. Cl. ..... 8/159; 68/12.12
(58) Field of Search ..... 8/158, 159; 68/12.12

(56) References Cited

U.S. PATENT DOCUMENTS 5,161,393 A * 11/1992 Payne et al. ..... 68/12.04
5,469,719 A * 11/1995 Imai et al. ..... 68/12.12 X
5,647,232 A 7/1997 Böldt et al. ..... 68/12.12 X
5,743,115 A * 4/1998 Hashimoto ..... 68/12.12
5,979,194 A * 11/1999 Matsumoto et al. ... 68/12.12 X

* cited by examiner

*Primary Examiner*—Philip Coe
(74) *Attorney, Agent, or Firm*—Robert E. Bushnell, Esq.

(57) ABSTRACT

Disclosed herein is a method for controlling a washing machine according to absorption characteristics of the laundry. The washing machine performs washing, rinsing and spin-drying steps in sequence. In the washing machine control method, first of all, a washing mode for absorption characteristics of laundry is set. A preset plural number of intermittent spin-drying operations are performed in the washing and rinsing steps in accordance with the set washing mode for absorption characteristics of the laundry.

3 Claims, 6 Drawing Sheets

METHOD FOR CONTROLLING WASHING MACHINE ACCORDING TO ABSORPTION CHARACTERISTICS OF THE LAUNDRY

CLAIM OF PRIORITY

This application makes reference to, incorporates the same herein, and claims all benefits accruing under 35 U.S.C. §119 from my application entitled CONTROL METHOD OF WASHING MACHINE CONSIDERING CHARACTERISTIC OF ABSORPTION IN CLOTHES filed with the Korean Industrial Property Office on Jul. 31, 2001 and there duly assigned Serial No. 2001-46165.

BACKGROUND OF THE INVENTION

1. Field of the Invention

The present invention relates generally to a method for controlling a washing machine, and more particularly to a method for controlling a washing machine according to absorption characteristics of the laundry, in such a way that when highly absorptive laundry is washed in the washing machine; during a rinsing step, a plural number of intermittent spin-drying operations are performed instead of a high-speed spin-drying operation to provide sufficient time for discharging water; and during a spin drying step, a sufficient number of spin-drying operations are performed to discharge water absorbed into the laundry and, thereafter, a normal spin-drying operation is performed to reach the final highest spin-drying speed.

2. Description of the Prior Art

In general, a washing machine has several washing modes to be selected by a user in accordance with the material of the laundry. Therefore, once one washing mode is selected by the user in accordance with the material of the laundry such as cotton, silk or synthetic fiber, the washing machine performs a washing cycle (consisting of washing, rinsing, and spin-drying steps) according to the preset information of the selected washing mode including washing time, washing speed, washing temperature, number of rinsing operations, spin-drying time, spin-drying speed and water level. Furthermore, some of options, such as washing temperature, spin-drying speed, and number of rinsing operation, may be manually selected by the user input.

Generally, even the laundry formed of the same material may absorb and discharge different amounts of water according to the weaving characteristics of the laundry. Accordingly, the amount of water absorbed by the laundry may be varied with the weaving pattern of the laundry. In particular, laundry formed of a pile texture in the form of loops, such as a towel or blanket, rapidly absorbs a large amount of water, and discharges a large amount of water during the spin-drying operation.

However, in the conventional method for controlling a washing machine, washing modes are classified into various types in accordance with only the material of the laundry, so the same rinsing and spin drying steps are carried out for the laundry formed of the same material. Accordingly, there arises a problem that the laundry formed of the same material are washed in the same manner regardless of their different water absorption characteristics, thereby hindering the laundry from being effectively rinsed and spin-dried.

SUMMARY OF THE INVENTION

Therefore, the present invention has been made in view of the above problem, and it is an object of the present invention to provide a method for controlling washing machine according to absorption characteristics of the laundry.

In order to accomplish the above object, the present invention provides a method for controlling a washing machine according to the absorption characteristics of the laundry, the washing machine performing washing, rinsing and spin-drying steps in sequence, comprising the steps of: setting a washing mode for the absorption characteristics of laundry; and performing a preset plural number of intermittent spin-drying operations in the washing and rinsing steps in accordance with the set washing mode for the absorption characteristics of the laundry.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
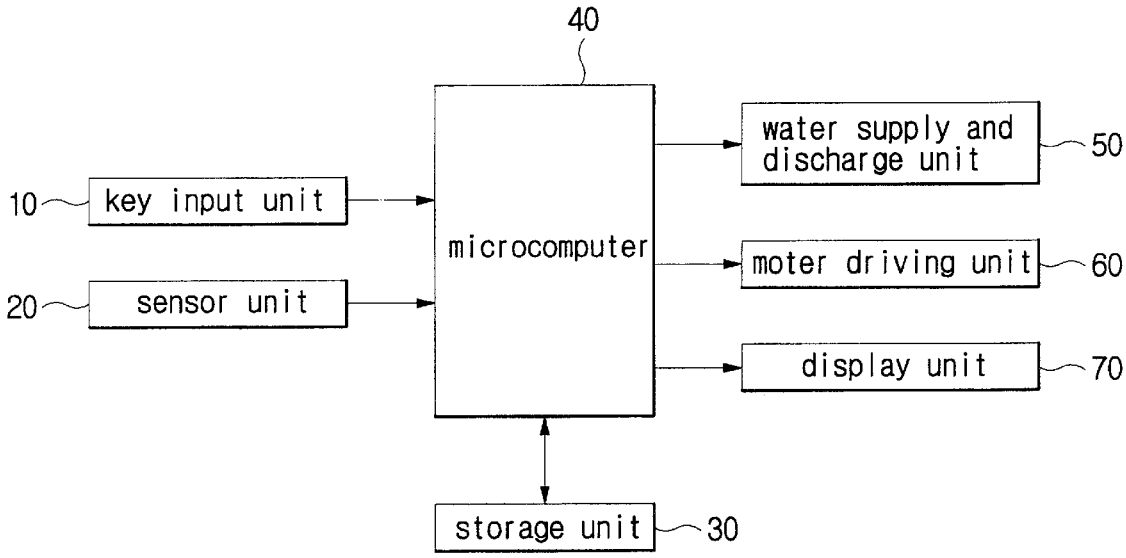
FIG. 1 is a block diagram illustrating a washing machine in accordance with the present invention.

Reference now should be made to the drawings, in which the same reference numerals are used throughout the different drawings to designate the same or similar components.

FIG. 1 is a block diagram illustrating a washing machine in accordance with the present invention.

Referring to FIG. 1, the washing machine of the present invention comprises a key input unit 10, a sensor unit 20, a storage unit 30, a microcomputer 40, a water supply and discharge unit 50, and a motor driving unit 60. The key input unit 40 allows the user to input a washing mode according to the material and absorption characteristics of the laundry. The sensor unit 20 senses washing information such as washing temperature, water level and laundry weight. The storage unit 30 stores operating modes for washing, rinsing and spin-drying steps corresponding to a washing mode to be inputted through the key input unit 10. The microcomputer 40 controls washing, rinsing and spin-drying steps, based on the washing mode and the information obtained through the key input unit 10 and sensor unit 20, respectively. The water supply and discharge unit 50 performs water supply and discharge operations according to a control signal of the microcomputer 40. The motor driving unit 60 performs the washing, rinsing, and spin-drying steps by operating a motor according to the control of the microcomputer 40.

Additionally, the washing machine of the present invention includes a display unit 70 for displaying selection items to allow the user to select a washing mode according to the material and absorption characteristics of the laundry.

The key input unit 10 includes a set of keys for inputting the material of the laundry such as cotton, mixed-spinning, synthetic fiber, wool and silk and a set of keys for inputting washing modes for the absorptive laundry. In this case, towels made of cotton and blankets made of blended spun and synthetic fiber generally absorb a large amount of water, so two keys for selecting either towels or blankets are provided in the key input unit 10, thereby carrying out rinsing and spin-drying steps according to the absorption characteristics of the laundry.

Figure 2:
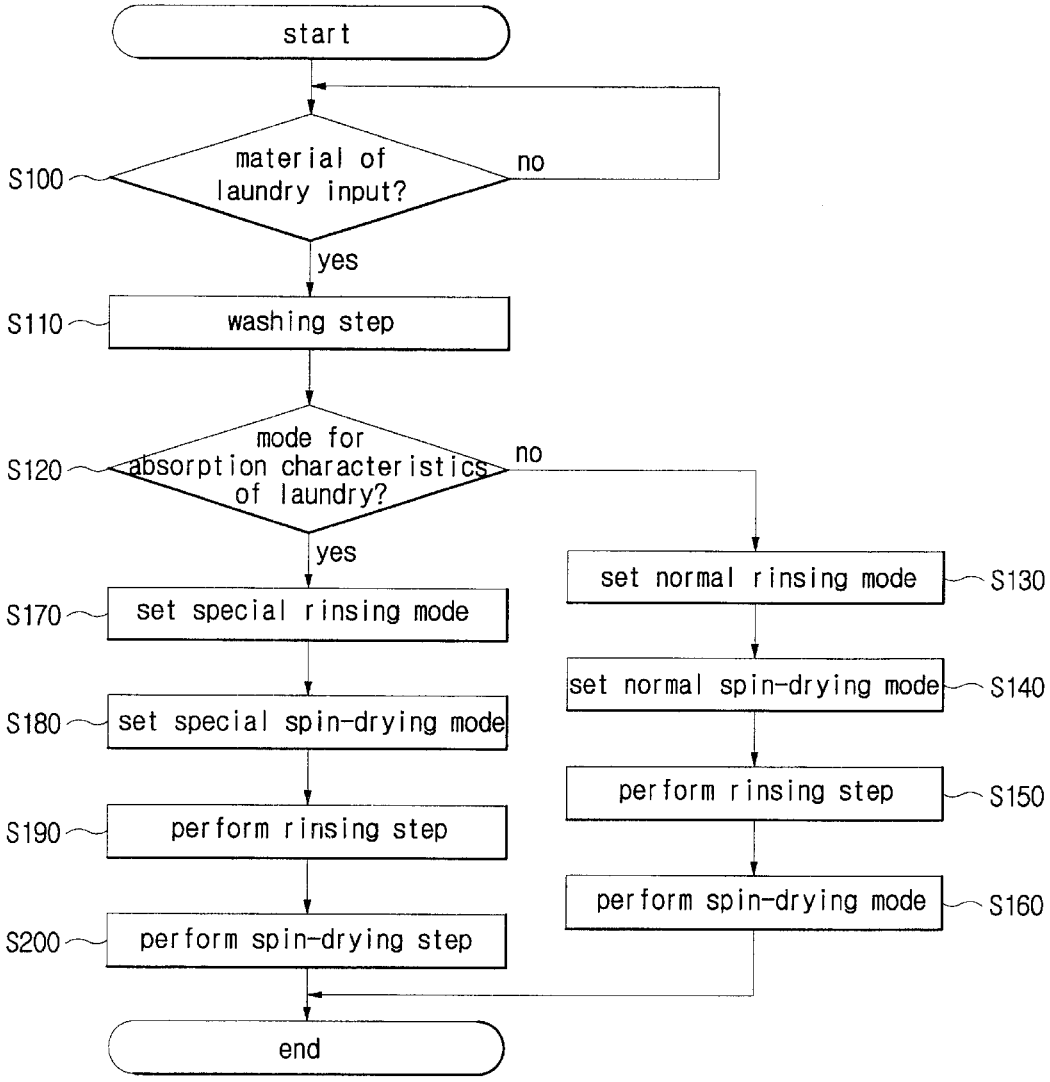
FIG. 2 is a flowchart illustrating a method for controlling a washing machine according to absorption characteristics of the laundry in accordance with the present invention.

FIG. 2 is a flowchart illustrating a method for controlling the washing machine according to the absorption characteristics of the laundry in accordance with the present invention.

Referring to FIG. 2, first of all, the microcomputer 40 controls the display unit 70 to display selection items so as to allow the user to select the material of the laundry, and the microcomputer 40 determines whether the material of the laundry is inputted (S100).

If the material of the laundry is inputted, the microcomputer 40 performs the washing step according to the operating mode, which corresponds to the inputted material of the laundry, as stored in the microcomputer 40 (S110).

If the washing step is finished, the microcomputer 40 determines whether a washing mode for the absorption characteristics of the laundry is set (S120). In this case, whether a washing mode for the absorption characteristics of the laundry is set is determined by determining whether a key for highly absorptive laundry is pressed.

If the washing mode for the absorption characteristics for the laundry is not set, the microcomputer 40 sets the rinsing and spin-drying steps as normal rinsing and spin-drying modes, respectively (S130 and S140). In such a case, in the normal rinsing mode, a preset plural number of intermittent spin-drying operations, a high-speed spin-drying operation, a maintained high-speed spin-drying operation and a rinsing operation are performed one after another. In the normal spin-drying mode, a preset plural number of intermittent spin-drying operations, a high-speed spin-drying operation and a maintained high-speed spin-drying operation are performed one after another. Thereafter, the microcomputer 40 performs the rinsing and spin-drying steps according to the normal rinsing and spin-drying modes preset in the microcomputer 40 (S150 and S160).

Meanwhile, if the washing mode for the absorption characteristics of the laundry is set, the microcomputer 40 sets the rinsing and spin-drying steps as special rinsing and spin-drying modes, respectively (S170 and S180). In this case, operation conditions for the special rinsing and spin-drying modes, such as number of rinsing operations, rinsing time, spin-drying time and spin-drying speed, are preset in the microcomputer 40 in accordance with the material and absorption characteristics of the laundry. Thereafter, the microcomputer 40 performs the rinsing and spin-drying steps according to the special rinsing and spin-drying modes preset in the microcomputer 40 (S190 and S200).

Figure 3:
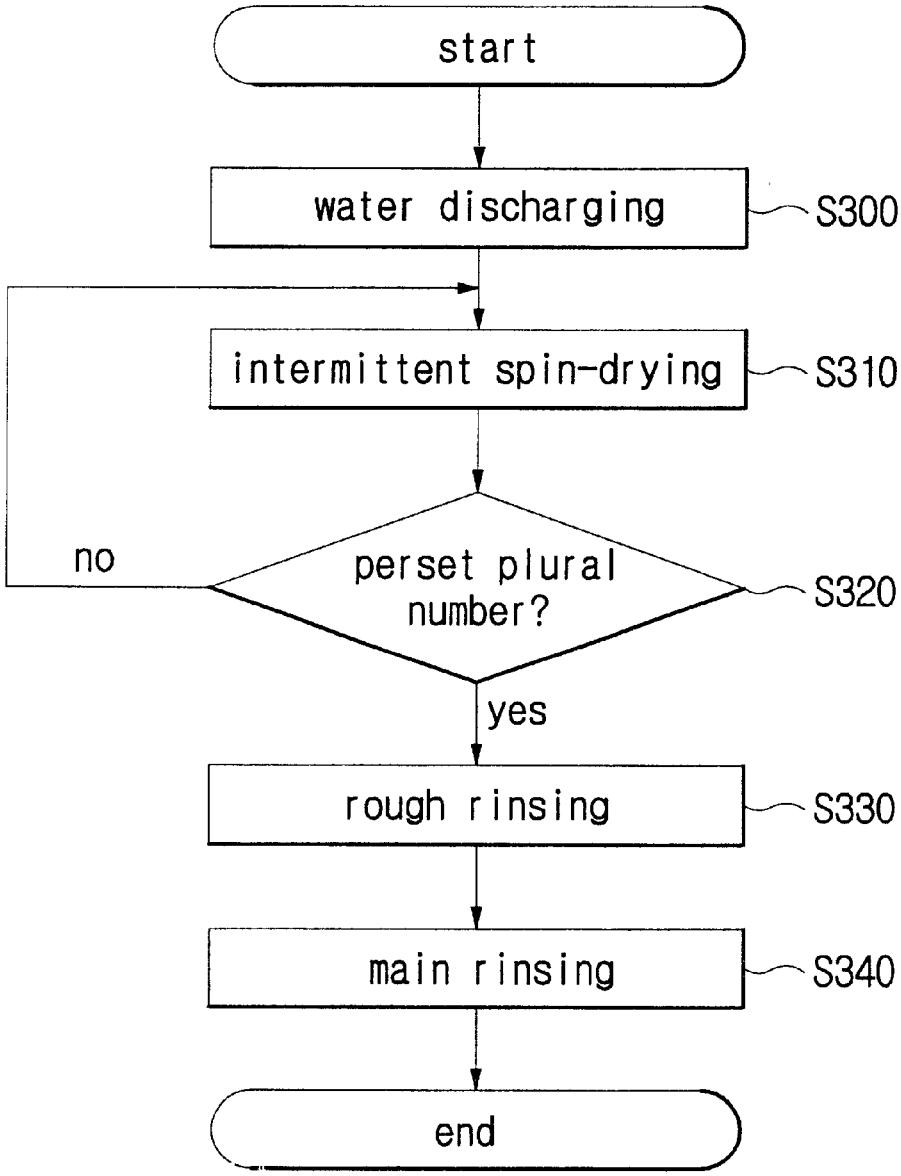
FIG. 3 is a flowchart illustrating a rinsing step according to the absorption characteristics of the laundry in accordance with the present invention.
Figure 4:
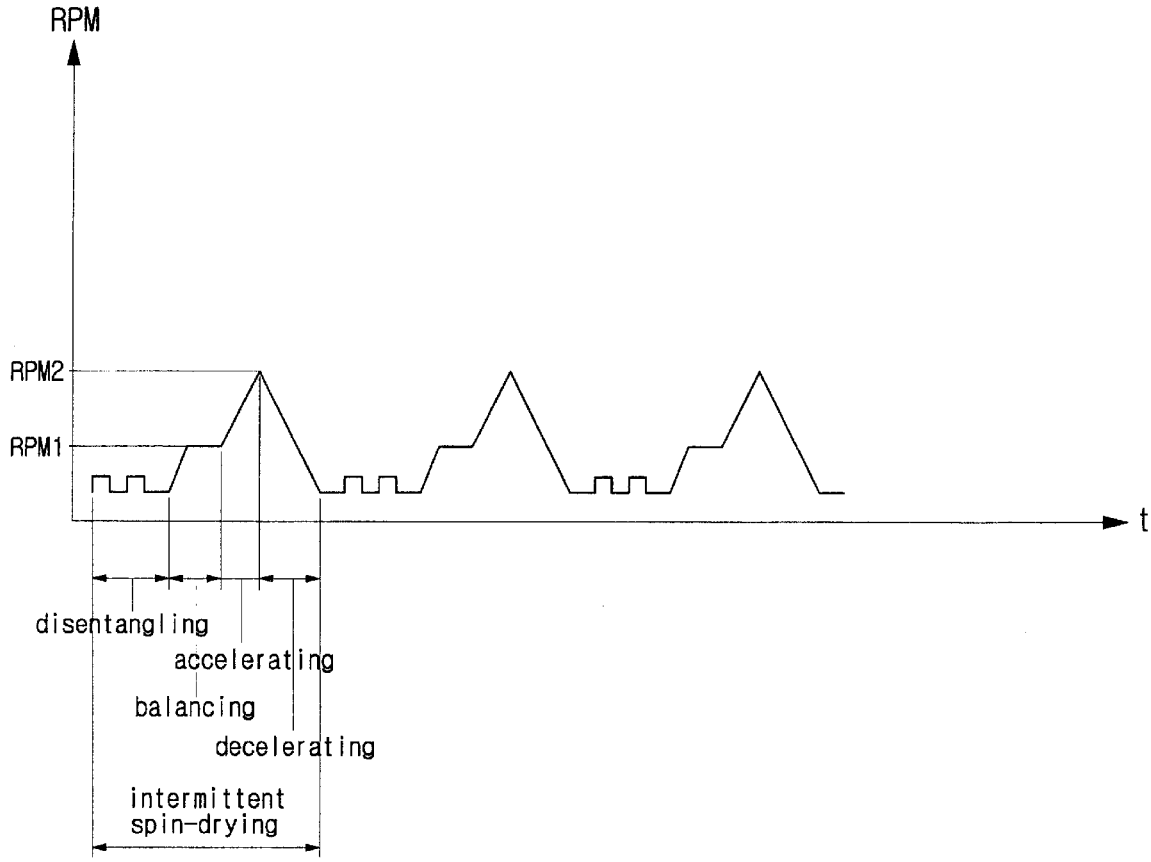
FIG. 4 is a waveform chart illustrating the intermittent spin-drying operation of FIG. 3.

FIG. 3 is a flowchart illustrating the rinsing step for absorptive laundry. FIG. 4 is a waveform chart illustrating the intermittent spin-drying operation of FIG. 3.

Referring to FIGS. 3 and 4, when the special rinsing step is initiated, the microcomputer 40 controls the water supply and discharge unit 50 to discharge used washing water (S300). After discharging the used water, the microcomputer 40 controls the motor driving unit 60 to perform the intermittent spin-drying operations (S310). In this case, during the intermittent spin-drying operations, disentangling of the laundry is carried out by the rotation of a motor, distributing (so-called balancing) of the laundry is performed by accelerating the motor to a first rotation speed (rpm 2, about 300 to 400 rpm) and maintaining the motor at the first rotation speed, accelerating and stopping of the motor are carried out by rotating the motor to a second rotation speed (rpm 2, about 300 to 400 rpm) and stopping the motor, and disentangling of the laundry is carried out again, thus discharging washing water from the laundry.

If the intermittent spin-drying operations are finished, the microcomputer 40 determines whether a preset plural number of intermittent spin-drying operations are performed (S320). The reason for this is that a large amount of water can be discharged even at a relatively low rotation speed (about 300 to 400 rpm) because the highly absorptive laundry absorbs a large amount of water, so the preset plural number of intermittent spin-drying operations provide sufficient time to discharge water to the outside.

If a preset plural number of intermittent spin-drying operations are performed, there is carried out a rough rinsing operation in which the laundry is rinsed by newly supplied water (S330). Subsequently, a main rinsing operation is carried out (S340).

Although the spin-drying operations are described as being performed in the rinsing step, the spin-drying operations are performed in the washing step in the same manner as the spin-drying operations in the rinsing step.

Figure 5:
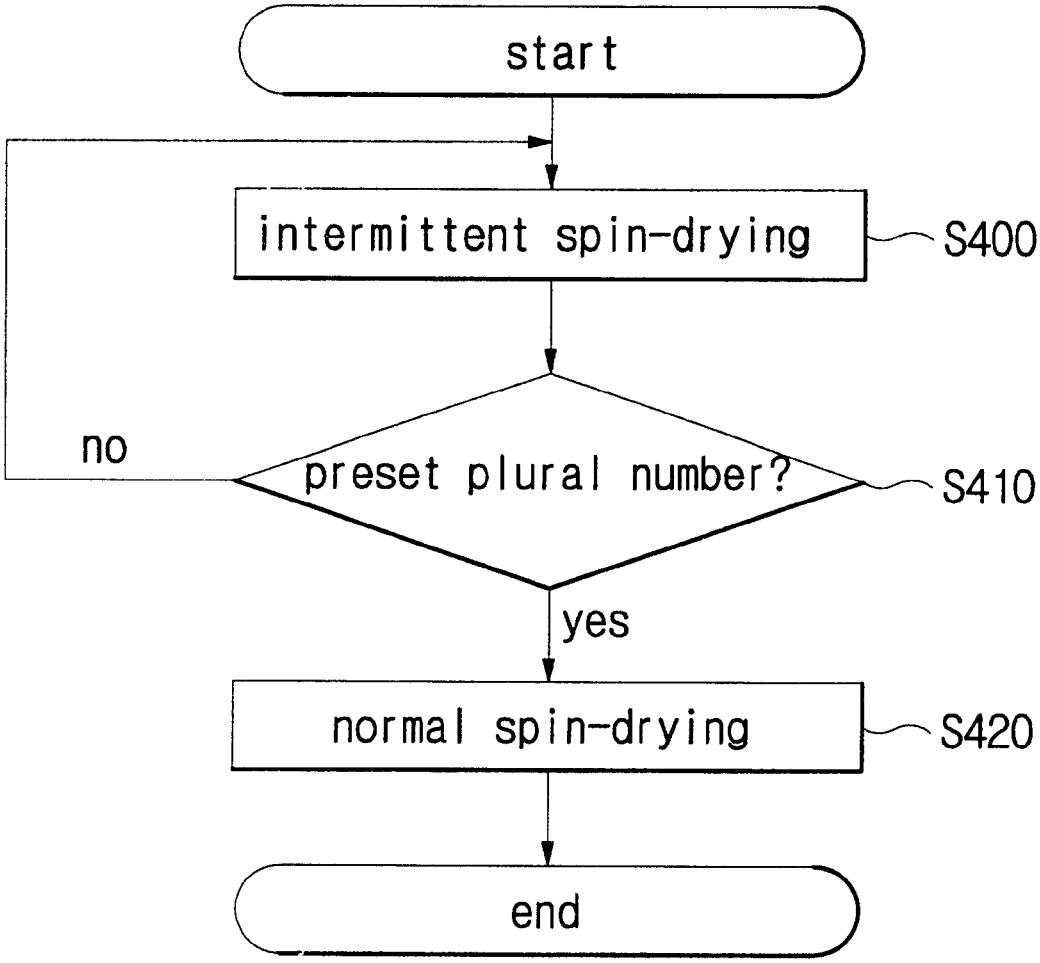
FIG. 5 is a flowchart illustrating a spin-drying step according to absorption characteristics of the laundry in accordance with the present invention.
Figure 6:
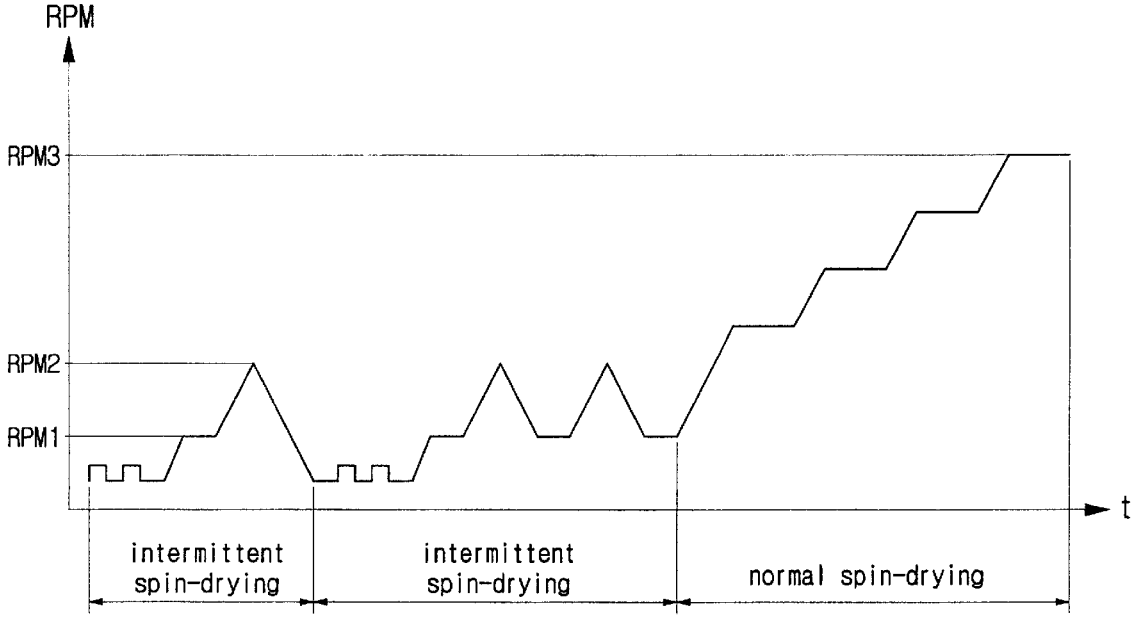
FIG. 6 is a waveform chart illustrating the intermittent and normal spin-drying operations of FIG. 5.

FIG. 5 is a flowchart illustrating a spin-drying step according to the absorption characteristics oft he laundry. FIG. 6 is a waveform chart illustrating the intermittent spin-drying step and normal spin-drying operations of FIG. 5.

Referring to FIG. 5 and FIG. 6, when a spin-drying step is initiated, the microcomputer 40 controls a motor to be rotated so as to perform intermittent spin-drying operations (S400). If the intermittent spin-drying operations are finished, the microprocessor 40 determines whether a preset plural number of intermittent spin-drying operations have been performed (S410).

If a preset plural number of intermittent spin-drying operation have been preformed, a normal spin-drying operation is performed by accelerating the rotation speed of a motor to a third rotation speed (rpm 3, the highest spin-drying speed) (S420). In such a case, the normal spin-drying operation is performed by controlling a motor for a predetermined spin-drying time period in a stepwise acceleration manner in which the rotation speed of the motor is increased to a predetermined speed, maintained at the speed for a predetermined period of time, increased to another predetermined speed, and maintained at the speed for a predetermined time period. The rotation speed of the motor is increased by 200 rpm in a stepwise manner until the rotation speed reaches the highest spin-drying speed, so problems caused by the abrupt increase in the degree of spin-drying can be prevented.

As described above in detail, in the washing machine control method of the present invention, rinsing and spin-drying steps are carried out according to the absorption characteristics of the laundry varying with the structure of weaved textile, so the rinsing and spin-drying performance of the washing machine is improved.

Furthermore, in the washing machine control method of the present invention, rinsing and spin-drying steps are performed, so damage to the laundry is reduced and the load of the washing machine is reduced due to the prevention of bubble formation during the spin-drying operation in the rinsing step.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for controlling a washing machine according to absorption characteristics of the laundry, the washing machine performing washing, rinsing and spin-drying steps in sequence, comprising the steps of:

setting a washing mode for absorption characteristics of laundry; and performing a preset plural number of intermittent spin-drying operations in the washing and rinsing steps in accordance with the set washing mode for absorption characteristics of the laundry.

2. The method as set forth in claim 1, wherein said spin-drying step is carried out by performing a normal spin-drying operation after performing a predetermined number of intermittent spin-drying operations.

3. The method as set forth in claim 2, wherein said normal spin-drying operation is performed by controlling a motor for a preset normal spin-drying time period in a stepwise acceleration manner.

* * * * *